US007347194B2

(12) United States Patent
Sato

(10) Patent No.: US 7,347,194 B2
(45) Date of Patent: Mar. 25, 2008

(54) LEAK DIAGNOSIS DEVICE

(75) Inventor: Kazuki Sato, Ichinomiya (JP)

(73) Assignee: Denso Corporation, Kariya, Aichi-pref. (JP)

( * ) Notice: Subject to any disclaimer, the term of this patent is extended or adjusted under 35 U.S.C. 154(b) by 0 days.

(21) Appl. No.: 11/705,604

(22) Filed: Feb. 13, 2007

(65) Prior Publication Data

US 2007/0246024 A1 Oct. 25, 2007

(30) Foreign Application Priority Data

Feb. 14, 2006 (JP) ..... 2006-037207

(51) Int. Cl.
*F02M 33/02* (2006.01)

(52) U.S. Cl. ..... 123/520; 123/518; 123/519; 73/118.1; 73/49.7

(58) Field of Classification Search ..... 123/516, 123/518, 519, 520; 73/118.1, 49.7
See application file for complete search history.

(56) References Cited

U.S. PATENT DOCUMENTS 6,971,375 B2 12/2005 Amano et al.
2005/0039525 A1* 2/2005 Wakahara et al. ..... 73/118.1
2005/0217348 A1* 10/2005 Amano et al. ..... 73/49.7
2006/0042605 A1 3/2006 Amano et al.
2006/0174698 A1* 8/2006 Chung et al. ..... 73/49.7
2007/0157908 A1* 7/2007 Kano et al. ..... 123/520
2007/0181103 A1* 8/2007 Okuda ..... 123/520
2007/0199374 A1* 8/2007 Shibuya ..... 73/118.1

FOREIGN PATENT DOCUMENTS

JP 2004-293438 10/2004

* cited by examiner

*Primary Examiner*—Stephen K. Cronin
*Assistant Examiner*—J. Page Hufty
(74) *Attorney, Agent, or Firm*—Nixon & Vanderhye P.C.

(57) ABSTRACT

Concentration measurement is performed multiple times from a period in which pressure in a purge device increases due to generation of fuel vapor after operation of an engine is stopped. A concentration stabilization period, in which a change in the fuel vapor concentration is equal to or less than a reference value, is calculated based on results of the multiple times of the concentration measurement. Leak diagnosis is performed during the concentration stabilization period. As a result, even if a period for the pressure in the purge device to stabilize fluctuates due to an environment in which a vehicle is located, the leak diagnosis can be performed immediately when the pressure in the purge device stabilizes and a state suitable for the leak diagnosis is reached.

7 Claims, 9 Drawing Sheets

LEAK DIAGNOSIS DEVICE

CROSS REFERENCE TO RELATED APPLICATION

This application is based on and incorporates herein by reference Japanese Patent Application No. 2006-37207 filed on Feb. 14, 2006.

BACKGROUND OF THE INVENTION

1. Field of the Invention

The present invention relates to a leak diagnosis device for performing leak diagnosis of determining whether there is a leak hole in a purge device, which adsorbs fuel vapor generated in a fuel tank with an adsorbent in a canister and purges the fuel vapor adsorbed by the adsorbent into an intake passage of an internal combustion engine.

2. Description of Related Art

The purge device inhibits diffusion of fuel vapor generated in a fuel tank to an atmosphere. The purge device introduces the fuel vapor in the fuel tank into a canister accommodating an adsorbent and temporarily adsorbs the fuel vapor with the adsorbent. The vapor fuel adsorbed by the adsorbent separates from the adsorbent due to a negative pressure generated in an intake pipe during operation of an internal combustion engine and is discharged (purged) to the intake pipe of the engine through a purge passage.

In such the purge device, if a leak hole is formed in a passage introducing the fuel vapor to the intake pipe of the engine, a canister or the like, the fuel vapor is discharged to the atmosphere through the leak hole. If the leak hole is formed in the purge device, the leak hole should be detected as early as possible. Therefore, for example, a leak diagnosis device described in JP-A-2004-293438 detects the pressure in the purge device at the time when the pressure in the purge device is decreased or increased. The leak diagnosis device performs leak diagnosis of existence or nonexistence of the leak hole in the purge device based on the magnitude of the pressure or the pressure change.

Since the leak diagnosis device diagnoses the existence or nonexistence of the leak hole by detecting the pressure in the purge device, it is difficult to perform the diagnosis accurately under a condition that the pressure in the purge device changes easily, e.g., under a condition that the pressure in the fuel tank changes because of shaking of the fuel in the fuel tank or a change in atmospheric pressure at the time when a vehicle is running on an upslope. Therefore, the diagnosis device described in JP-A-2004-293438 performs the diagnosis when the pressure in the purge device stabilizes, i.e., during an idling state or after the engine is stopped.

However, a large amount of the fuel vapor is generated immediately after the engine is stopped because the fuel temperature has increased due to heat generation from a fuel pump provided in the fuel tank, for example. Accordingly, the pressure in the purge device is unstable. Therefore, the leak diagnosis after the stopping of the engine is performed when a predetermined period necessary for the pressure in the purge device to stabilize elapses.

However, practically, the period necessary for stabilizing the pressure in the purge device and for providing a suitable condition for the leak diagnosis fluctuates due to influences of an environment in which the vehicle is located (e.g., ambient temperature, solar radiation, radiant heat from ground or wind). Therefore, in the case where the leak diagnosis is performed when the predetermined period elapses after the engine is stopped, the predetermined period has to be set sufficiently long in order to ensure the accuracy of the leak diagnosis even under a certain environmental condition that requires the longest period for the pressure in the purge device to stabilize. Thus, the predetermined period has to be set relatively long. Accordingly, there is a great possibility that the engine is restarted before the predetermined period elapses after the engine is stopped and that the opportunity of the leak diagnosis is reduced.

SUMMARY OF THE INVENTION

It is an object of the present invention to provide a leak diagnosis device capable of performing leak diagnosis as soon as possible when a state suitable for performing the leak diagnosis is provided after an operation of an internal combustion engine is stopped.

According to an aspect of the present invention, a leak diagnosis device has a diagnosing device for performing leak diagnosis of determining whether a leak hole is formed in a purge device that adsorbs a fuel vapor generated in a fuel tank with an adsorbent in a canister and purges the adsorbed fuel vapor to an intake passage of an internal combustion engine. The leak diagnosis device has a state sensing device. When the adsorbed fuel vapor separates from the adsorbent and produces a mixture gas, the state sensing device senses a state of the fuel vapor in the mixture gas. The leak diagnosis device has a period calculating device for making the state sensing device perform the state sensing multiple times from a period in which the pressure in the purge device increases due to generation of the fuel vapor after an operation of the engine is stopped. The period calculating device calculates a state stabilization period in which a change of the fuel vapor state becomes equal to or less than a reference value based on a result of the multiple times of the state sensing. The diagnosing device performs the leak diagnosis in the state stabilization period calculated by the period calculating device.

Immediately after the engine stops the operation, the fuel temperature has increased due to the heat generation from the fuel pump provided in the fuel tank, for example. Therefore, a large amount of the fuel vapor is generated. When the large amount of the fuel vapor is generated, the pressure in the purge device connected to the fuel tank increases with time. However, if the pressure in the purge device increases to pressure corresponding to the generation of the fuel vapor (i.e., amount of generated fuel vapor), the pressure stops increasing further and the pressure in the purge device reaches a stable state.

At that time, a state of equilibrium is made such that the generation of the fuel vapor substantially coincides with a disappearing amount of the fuel vapor due to liquefaction of the fuel vapor (i.e., amount of fuel vapor disappearing due to liquefaction). Accordingly, the state of the fuel vapor (fuel vapor state) in the purge device becomes substantially constant. Thus, the change in the fuel vapor state is correlated with the pressure change in the purge device. Accordingly, it can be accurately determined that the pressure in the purge device is stabilized and the state suitable for the leak diagnosis is reached based on magnitude of the change in the fuel vapor state in the purge device.

Therefore, the above-described leak diagnosis device makes the state sensing device perform the state sensing multiple times from the period in which the pressure in the purge device increases due to the generation of the fuel vapor after the operation of the engine is stopped. The leak diagnosis device calculates the state stabilization period, in which the change in the fuel vapor state becomes equal to or less than the reference value, based on the result of the multiple times of the state sensing. The leak diagnosis device performs the leak diagnosis during the state stabilization period. As a result, even if the time for the pressure in the purge device to stabilize fluctuates depending on the environment in which the vehicle is located, the leak diagnosis can be performed immediately when the pressure in the purge device stabilizes and the state suitable for the leak diagnosis is reached. Accordingly, the period from the stopping of the engine to the execution of the leak diagnosis can be shortened compared to conventional technologies. As a result, the number of opportunities to perform the leak diagnosis can be increased.

BRIEF DESCRIPTION OF THE DRAWINGS

Features and advantages of an embodiment will be appreciated, as well as methods of operation and the function of the related parts, from a study of the following detailed description, the appended claims, and the drawings, all of which form a part of this application. In the drawings:

DETAILED DESCRIPTION OF EXAMPLE EMBODIMENT

Figure 1:
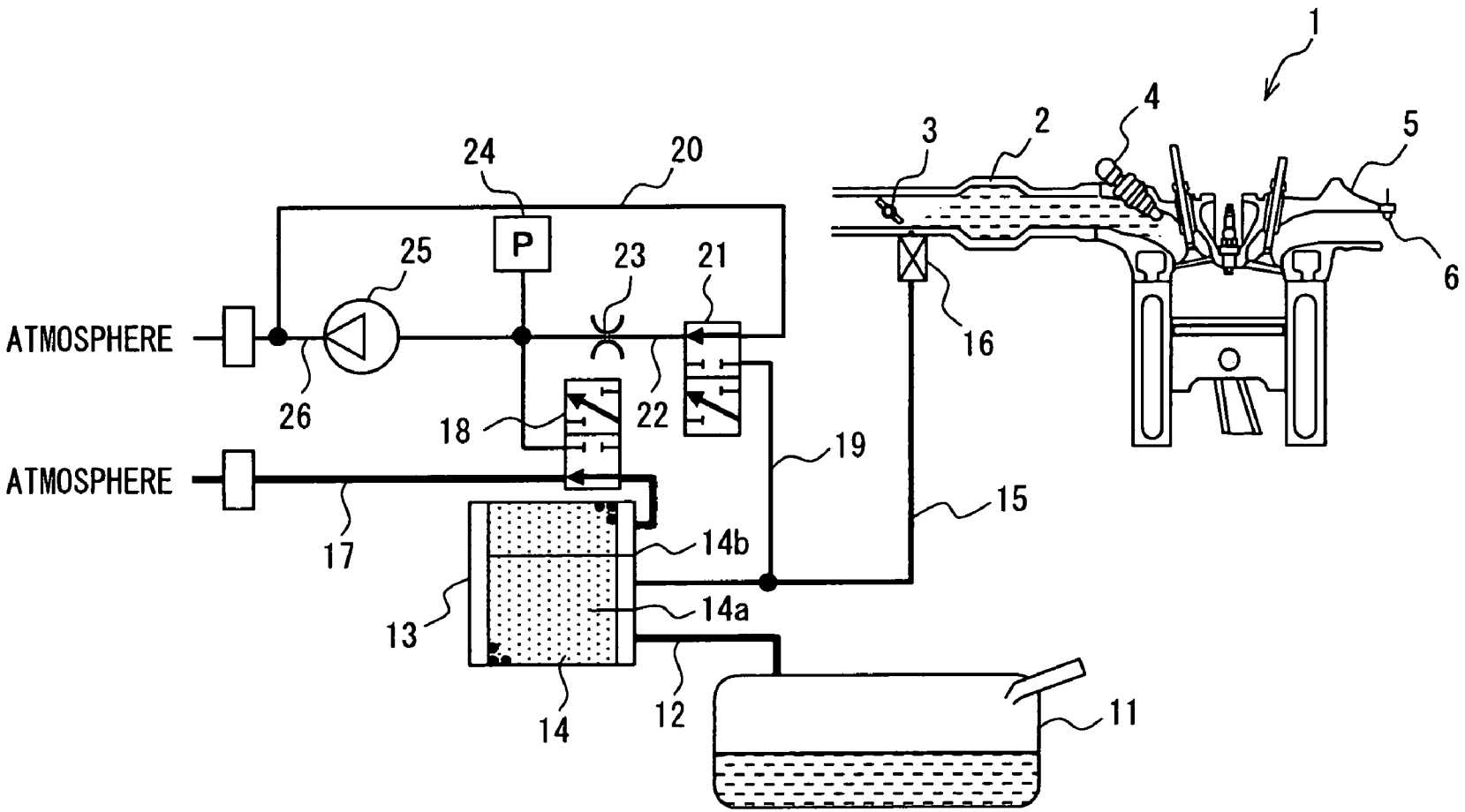
FIG. 1 is a schematic diagram showing a fuel vapor treatment device according to an example embodiment of the present invention.

Referring to FIG. 1, a purge device having a leak diagnosis function according to an example embodiment of the present invention is illustrated. The purge device according to the present embodiment is applied to an engine of an automobile, for example. A fuel tank 11 of an engine 1 as an internal combustion engine is connected with a canister 13 through an evaporation line 12 as a vapor introduction passage. The canister 13 is filled with an adsorbent 14, which temporarily adsorbs (and/or absorbs) the fuel vapor generated in the fuel tank 11. The canister 13 is connected with an intake pipe 2 of the engine 1 through a purge line 15. A purge valve 16 is provided in the purge line 15. The canister 13 communicates with the intake pipe 2 when the purge valve 16 is open.

A partition plate 14*a* reaching the adsorbent 14 is disposed in the canister 13 between a position where the evaporation line 12 is connected to the canister 13 and a position where the purge line 15 is connected to the canister 13. Thus, the fuel vapor introduced from the evaporation line 12 is prevented from being discharged from the purge line 15 without being adsorbed by the adsorbent 14. The canister 13 is also connected with an atmosphere line 17. A partition plate 14*b* having substantially the same depth as the filled depth of the adsorbent 14 is located in the canister 13 between a position where the atmosphere line 17 is connected to the canister 13 and the position where the purge line 15 is connected to the canister 13. Thus, the fuel vapor introduced from the evaporation line 12 is prevented from being discharged through the atmosphere line 17.

The purge valve 16 is an electromagnetic valve. An opening degree of the purge valve 16 is regulated by an electronic control unit (not shown) controlling various parts of the engine 1. A flow amount of a mixture gas that contains the fuel vapor and flows through the purge line 15 is controlled by the opening degree of the purge valve 16. The mixture gas having undergone the control of the flow amount is purged into the intake pipe 2 by the negative pressure in the intake pipe 2 caused by a throttle valve 3. The mixture gas is combusted together with fuel injected by an injector 4. The mixture gas that contains the fuel vapor and that is purged is referred to as a purge gas, hereinafter.

The atmosphere line 17 having a tip end opening into the atmosphere through a filter is connected with the canister 13. A switching valve 18 is provided in the atmosphere line 17 for selectively allowing the canister 13 to communicate with the atmosphere line 17 or a suction side of a pump 25. The switching valve 18 is at a first position for providing the communication between the canister 13 and the atmosphere line 17 when the switching valve 18 is not driven by the electronic control unit. The switching valve 18 is switched to a second position for making the canister 13 communicate with the suction side of the pump 25 not through a restrictor 23 when the switching valve 18 is driven. The switching valve 18 is switched to the second position when leak diagnosis is performed for checking existence or nonexistence of a leak hole, which causes leak of the fuel vapor, in the evaporation line 12, the purge line 15, the canister 13 or the like.

A branch line 19 branching from the purge line 15 is connected with one of inlet ports of a two-position valve 21. An air supply line 20 branching from a discharge line 26 of the pump 25 opening into the atmosphere through a filter is connected with the other inlet port of the two-position valve 21. An outlet port of the two-position valve 21 is connected with a measurement line 22. The two-position valve 21 is switched between a first position for connecting the air supply line 20 with the measurement line 22 and a second position for connecting the branch line 19 with the measurement line 22 by the electronic control unit. The two position valve is positioned at the first position when the two-position valve 21 is not driven by the electronic control unit.

The restrictor 23 and the pump 25 are provided in the measurement line 22. The pump 25 as a gas flow generating device is an electric pump. If the pump 25 is driven, the pump 25 causes the gas to flow through the measurement line 22 such that the restrictor 23 side is a suction side. The electronic control unit controls on/off of the drive and rotation speed of the pump 25. When the electronic control unit drives the pump 25, the electronic control unit controls the pump 25 to maintain the rotation speed constant at a predetermined value.

If the electronic control unit drives the pump 25 when the two-position valve 21 is set at the first position and the switching valve 18 is retained at the first position, a first measurement state is provided such that the air flows through the measurement line 22. If the pump 25 is driven when the two-position valve 21 is set at the second position, a second measurement state is provided such that the purge gas supplied through the atmosphere line 17, the canister 13, a part of the purge line 15 extending to the branch line 19 and the branch line 19 flows through the measurement line 22.

A pressure sensor 24 is provided in the measurement line 22 downstream of the restrictor 23, i.e., between the restrictor 23 and the pump 25, for sensing the pressure (negative pressure) generated by the restrictor 23 when the air or the purge gas flows there. The pressure measured by the pressure sensor 24 is outputted to the electronic control unit.

The electronic control unit controls the opening degree of the throttle valve 3 provided in the intake pipe 2 for regulating the intake air amount, the fuel injection amount from the injector 4 and the like based on sensing values sensed by various sensors. For example, the electronic control unit controls the fuel injection amount, the throttle opening degree and the like based on an intake air amount sensed by an airflow sensor provided in the intake pipe 2, intake pressure sensed by an intake pressure sensor, an air-fuel ratio sensed by an air-fuel ratio sensor 6 provided in an exhaust pipe 5, an ignition signal, engine rotation speed, engine coolant temperature, an accelerator position and the like.

Figure 2:
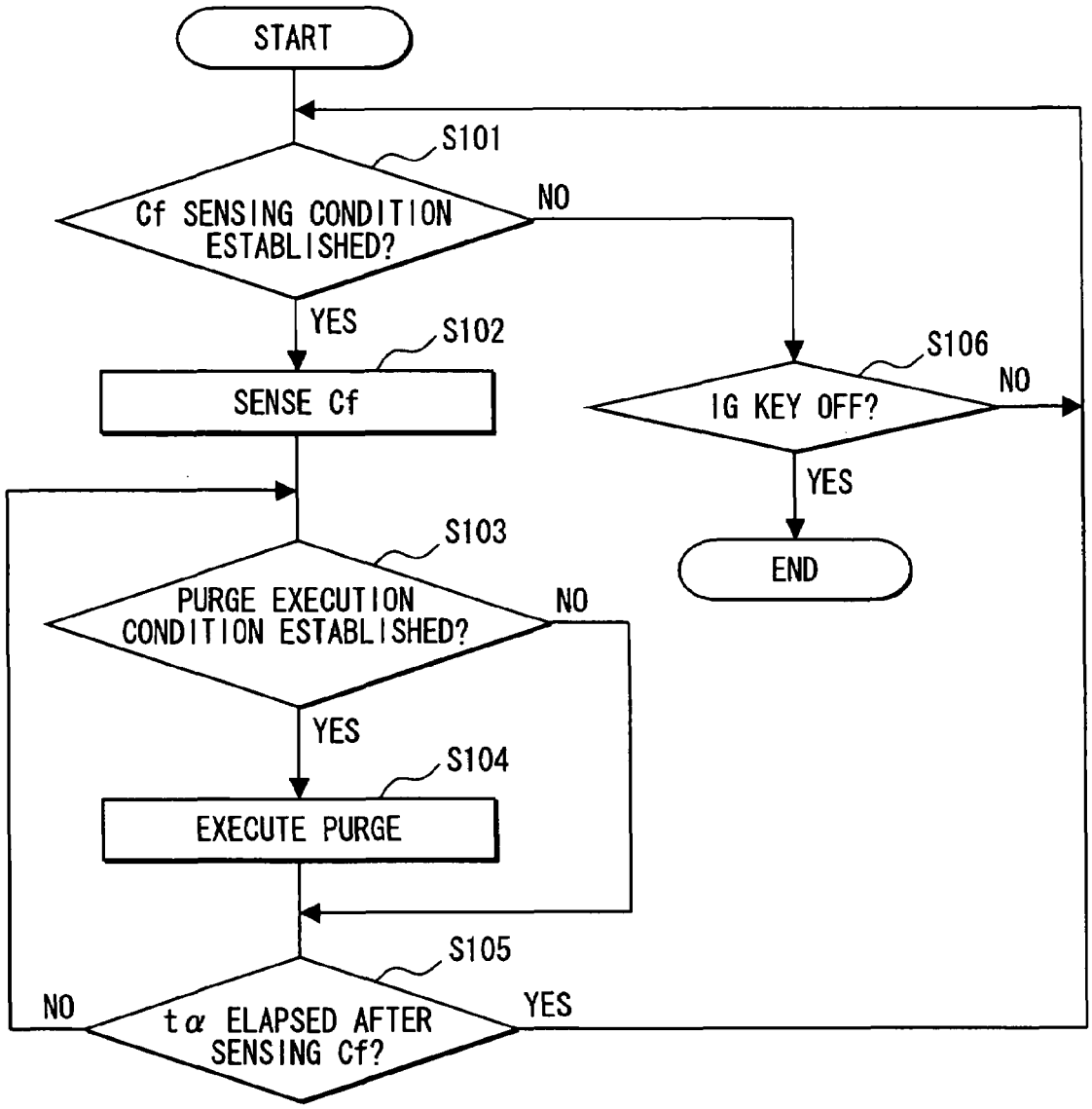
FIG. 2 is a flowchart showing purge control according to the FIG. 1 embodiment.

The electronic control unit also performs purge control for treating the fuel vapor in addition to the above-described control. Next, the purge control will be explained in reference to a flowchart of the purge control shown in FIG. 2. The purge control shown in FIG. 2 is executed if the engine 1 starts operation. First, Step S101 determines whether a concentration sensing condition is established. The concentration sensing condition is established when a state amount representing an operation state such as the engine coolant temperature, oil temperature or the engine rotation speed is in a predetermined range. Setting is made such that the concentration sensing condition is established before a purge execution condition for allowing execution of the purge of the fuel vapor is established.

The purge execution condition is established if the engine coolant temperature becomes equal to or higher than a predetermined value T1 and it is determined that engine warm-up is completed. Accordingly, the concentration sensing condition has to be established during the engine warm-up. Therefore, setting is made such that the concentration sensing condition is established when the coolant temperature is equal to or higher than a predetermined value T2 set lower than the predetermined value T1, for example. The setting is made such that the concentration sensing condition is established also during a period in which the purge of the fuel vapor is stopped during the operation of the engine (mainly, deceleration period). In the case where the purge device is applied to a hybrid vehicle using an internal combustion engine and an electric motor as power sources, the setting is made such that the concentration sensing condition is established also when the vehicle stops the engine and runs on the motor.

Figure 3:
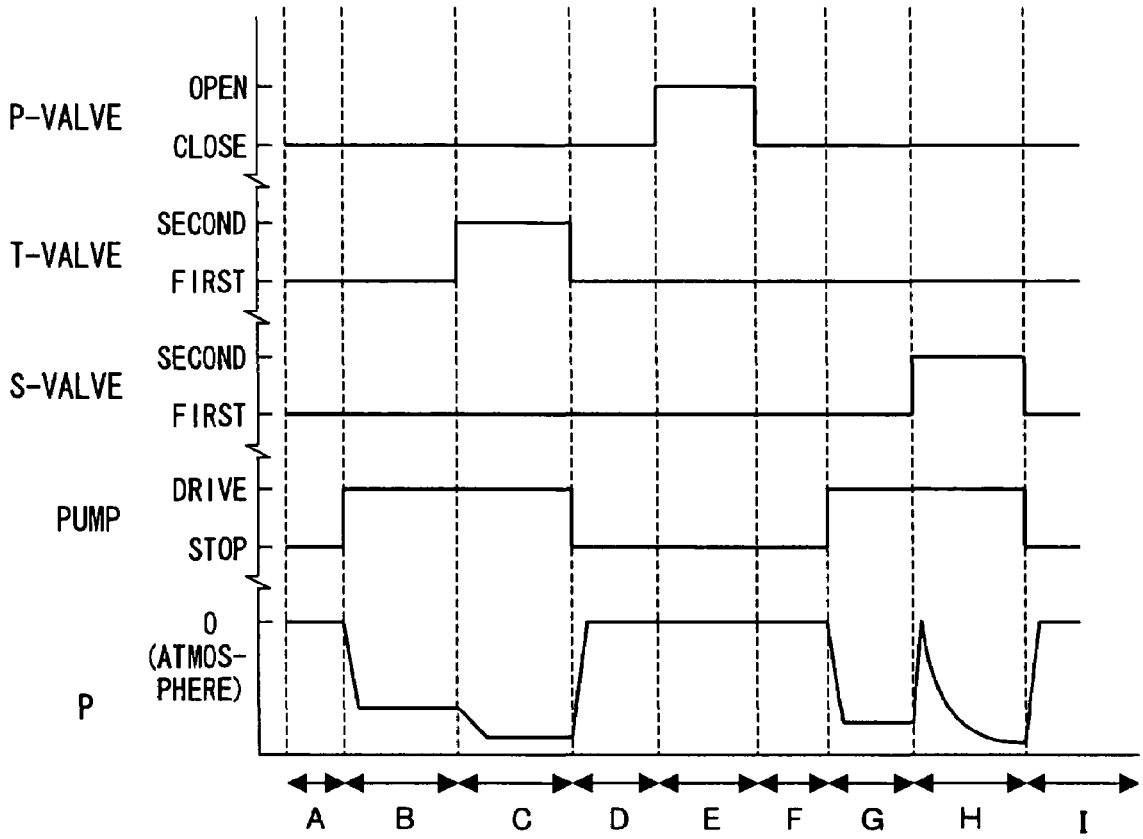
FIG. 3 is an operation waveform diagram showing operation states of respective parts of a purge device according to the FIG. 1 embodiment.

If Step S101 determines that the concentration sensing condition is established, the process goes to Step S102 to sense the concentration Cf of the fuel vapor in the purge gas. Next, a concentration sensing method will be explained in reference to an operation waveform chart of FIG. 3 showing operation states of various parts. The various parts are in initial states in an A period shown in FIG. 3 before the sensing of the concentration Cf. That is, the purge valve 16 (P-VALVE in FIG. 3) is closed, and the switching valve 18 (S-VALVE in FIG. 3) is positioned at the first position (FIRST in FIG. 3) for providing the communication between the canister 13 and the atmosphere line 17. The two-position valve 21 (T-VALVE in FIG. 3) is at the first position (FIRST in FIG. 3) for connecting the air supply line 20 with the measurement line 22. Therefore, in the initial state, the pressure (P in FIG. 3) sensed by the pressure sensor 24 substantially conforms to the atmospheric pressure (0 in FIG. 3).

Pressure P0 is measured with the pressure sensor 24 in the first measurement state in which the air is made to flow through the measurement line 22 as the gas flow. The measurement of the pressure P0 using the air flow is performed in a B period in the operation waveform chart shown in FIG. 3. The measurement is executed by driving the pump 25 (DRIVE in FIG. 3) while holding the two-position valve 21 at the first position. In this case, the air is supplied into the measurement line 22 through the air supply line 20. Therefore, the pressure sensor 24 senses the pressure (negative pressure) caused by the restrictor 23 when the air flows through the measurement line 22.

At that time, the pressure sensor 24 repeatedly senses the pressure downstream of the restrictor 23 at a predetermined time interval after the pump 25 is driven, for example. The pressure sensor 24 measures a converged value of the pressure P0 of the air flow at the time when a constant state, in which the air flow flows at speed corresponding to constant rotation speed of the pump 25, is reached.

Then, pressure P1 is measured in the second measurement state in which the purge gas is made to flow through the measurement line 22 as the gas flow. The measurement of the pressure P1 caused by the purge gas is executed in a C period in the waveform chart shown in FIG. 3. The measurement is performed by driving the pump 25 while switching the two-position valve 21 to the second position (SECOND in FIG. 3). In this case, the purge gas supplied through the atmosphere line 17, the canister 13, a part of the purge line 15 extending to the branch line 19 and the branch line 19 flows through the measurement line 22. Since the air introduced through the atmosphere line 17 flows through the canister 13, the purge gas is the mixture gas of the fuel vapor and the air. The purge gas is supplied to the measurement line 22 through the part of the purge line 15 and the branch line 19. Accordingly, when the pressure is measured with the use of the purge gas flow, the pressure sensor 24 senses the pressure (negative pressure) caused by the restrictor 23 when the purge gas flows through the measurement line 22.

At that time, the pressure sensor 24 repeatedly senses the pressure downstream of the restrictor 23, for example, at a predetermined time interval after the pump 25 is driven as in the pressure measurement using the air flow. Thus, a converged value of the pressure P1 caused by the purge gas flow is measured.

If the pressure P0 due to the air flow and the pressure P1 due to the purge gas flow are measured, the fuel vapor concentration Cf as a fuel vapor state is calculated based on the pressures P0, P1 and is stored to be used in the purge control (described after). The fuel vapor concentration Cf can be calculated by multiplying a pressure ratio between the pressures P0, P1 by a predetermined coefficient.

If the concentration sensing is ended, the various parts of the purge device are set at a purge execution condition establishment waiting state. The switching processing to the purge execution condition establishment waiting state corresponds to a D period in the waveform chart shown in FIG. 3. The switching processing is performed by stopping the drive of the pump 25 (STOP in FIG. 3) while switching the two-position valve 21 to the first position. The purge execution condition establishment waiting state is similar to the initial state.

Following Step S103 determines whether the purge execution condition is established. The purge execution condition is determined based on the operation states such as the engine coolant temperature, the oil temperature and the engine rotation speed as in a general purge device. If Step S103 is YES, the process goes to Step S104 to execute the purge.

When the purge is executed, the engine operation states are sensed. The purge gas flow rate is calculated based on the sensed engine operation states. For example, the purge gas flow rate is calculated based on the fuel injection amount required under the engine operation states such as the present throttle opening degree, the lower limit value of the fuel injection amount controllable with the injector 4 and the like. The opening degree of the purge valve 16 for achieving the purge gas flow rate is calculated based on the fuel vapor concentration Cf. In accordance with the thus-calculated opening degree, the purge valve 16 is opened until a purge stop condition is established. Thus, even if the purge is executed, the air fuel ratio can be accurately controlled to an aimed value.

The purge execution period corresponds to an E period in the waveform chart shown in FIG. 3. In this case, the purge valve 16 is opened at the calculated opening degree while holding the two-position valve 21 and the switching valve 18 at the respective first positions. As a result, the fuel vapor separates from the adsorbent 14 of the canister 13 due to the negative pressure in the intake pipe 2. Thus, the purge gas containing the fuel vapor is purged from the purge line 15.

If Step S103 is NO, Step S105 determines whether a predetermined period $t\alpha$ has elapsed after the fuel vapor concentration Cf is sensed. If Step S105 is NO, the process returns to the processing of Step S103. If Step S105 is YES, the process returns to the processing of Step S101. The processing for sensing the fuel vapor concentration Cf is performed again, and the fuel vapor concentration Cf is updated with the newest value.

If Step S101 is NO, the process goes to Step S106. Step S106 determines whether an ignition key (IG KEY) is turned off. If Step S106 is NO, the process returns to the processing of Step S101. If Step S106 is YES, the processing shown by the flowchart of FIG. 2 is ended.

Figure 4:
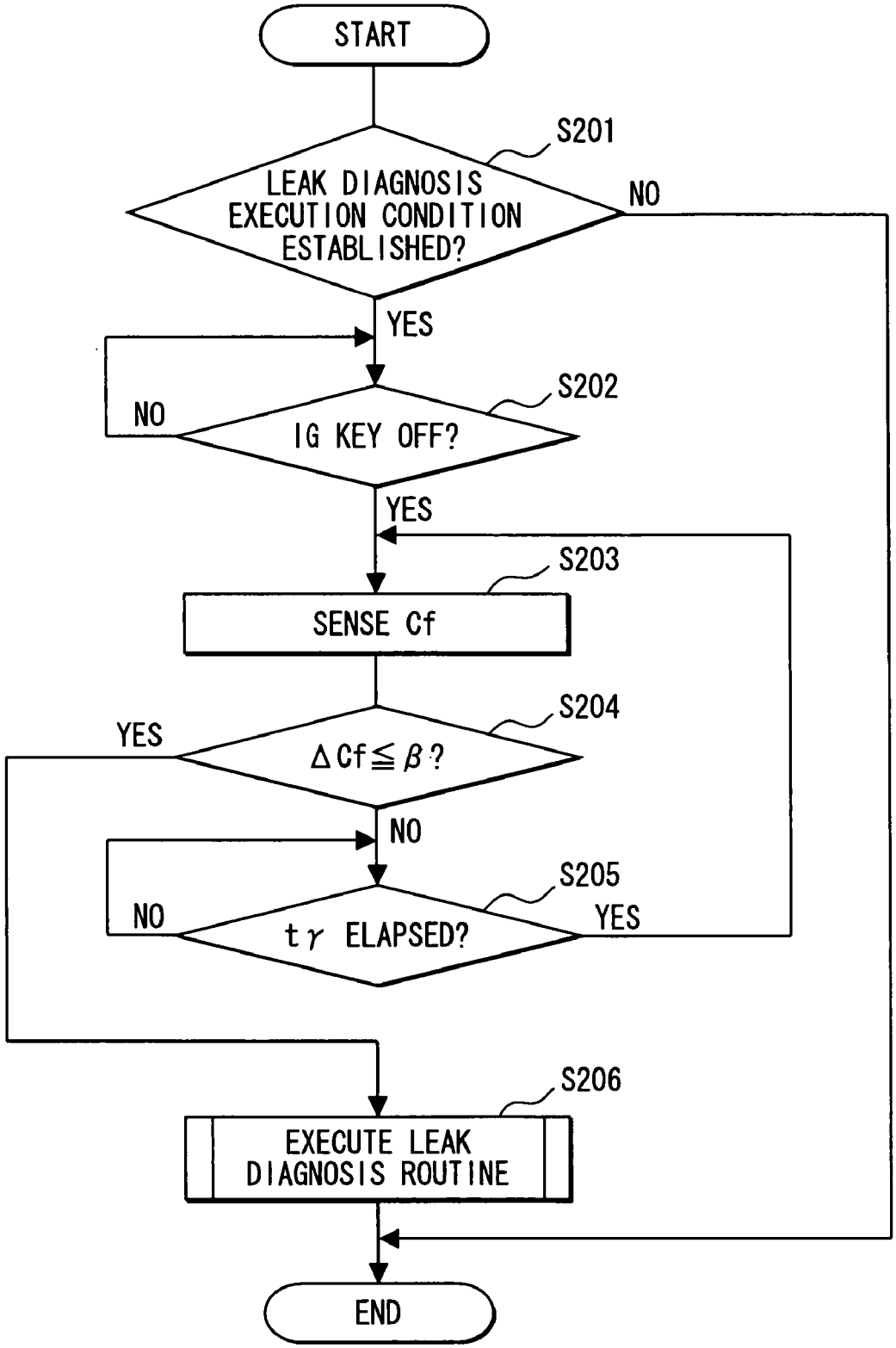
FIG. 4 is a flowchart showing leak diagnosis processing according to the FIG. 1 embodiment.

Next, the leak diagnosis function of the purge device according to the present embodiment will be explained. As shown in FIG. 1, the fuel vapor can diffuse in the evaporation line 12, the canister 13 and the purge line 15 extending to the purge valve 16 in the purge device. Accordingly, if the leak hole is formed in the space in which the fuel vapor diffuses in the purge device, the fuel vapor is discharged to the atmosphere through the leak hole. The purge device according to the present embodiment has the leak diagnosis function. A flowchart shown in FIG. 4 shows diagnosis processing for executing the leak diagnosis function according to the present embodiment. Explanation will be given based on the flowchart shown in FIG. 4.

Step S201 of the flowchart shown in FIG. 4 determines whether a leak diagnosis execution condition is established. Setting is made such that the leak diagnosis execution condition is established if the vehicle operation period continues for at least a predetermined time or if ambient temperature is equal to or higher than predetermined temperature. According to the OBD regulations of the United States, a leak check execution condition is established if following conditions are satisfied: operation continues for at least 600 seconds at ambient temperature of 20° F. or above and altitude of 8,000 feet or below; a cumulative operation period at 25 mph or above is 300 seconds or greater; and the operation includes continuous idling for 30 seconds or greater.

If Step S201 is NO, the diagnosis processing of the flowchart shown in FIG. 3 is ended. If Step S201 is YES, Step S202 determines whether the ignition key is turned off, i.e., whether the operation of the engine 1 is stopped. If Step S202 is NO, the process waits until the ignition key is turned off.

If Step S202 determines that the ignition key is turned off and the engine 1 is stopped, the process goes to Step S203 to sense the fuel vapor concentration Cf as the fuel vapor state in the purge gas. That is, in the leak diagnosis processing according to the present embodiment, the first sensing of the concentration Cf of the fuel vapor is performed immediately after the engine 1 is stopped. The sensing of the concentration Cf of the fuel vapor is performed by the processing similar to the above described processing.

Step S204 determines whether a change $\Delta Cf$ between the previous concentration Cf and the present concentration Cf is "equal to or less than" a reference value $\beta$ based on the concentration sensing result obtained at Step S203. The change from the previous concentration Cf cannot be calculated when the concentration sensing is performed for the first time. Accordingly, Step S204 is NO at this time, and the process goes to Step S205. Step S205 determines whether a predetermine period $t\gamma$ has elapsed after the concentration sensing performed at Step S203. In order to execute the concentration sensing multiple times during a period since the engine 1 stops the operation until the pressure in the purge device stabilizes (for example, three to five hours), the predetermined period $t\gamma$ is set at a period sufficiently shorter (thirty minutes or sixty minutes, for example) than the period for the pressure in the purge device to stabilize.

Since the fuel temperature has increased due to the influence of the heat generation from the fuel pump provided in the fuel tank 11 and the like immediately after the engine 1 stops the operation, a large amount of the fuel vapor is generated. When the large amount of the fuel vapor is generated, the pressure in the purge device connected with the fuel tank 11 also increases with time. If the pressure in the purge device increases to the pressure corresponding to the generation amount of the fuel vapor (i.e., amount of generated fuel vapor), the pressure stops increasing and the pressure in the purge device reaches a stabilized state.

If Step S205 determines that the predetermined period $t\gamma$ has elapsed after the previous concentration sensing, the process goes to Step S203 to perform the sensing of the concentration Cf of the fuel vapor again. Then, Step S204 determines whether the concentration change $\Delta Cf$ becomes equal to or less than the reference value $\beta$ and the fuel vapor concentration Cf stabilizes.

The state in which the fuel vapor concentration Cf is stable is an equilibrium condition in which the generation amount of the fuel vapor is substantially equal to a disappearing amount of the fuel vapor disappearing because of liquefaction of the fuel vapor. Accordingly, the fuel vapor concentration Cf in the purge device is substantially constant. If the generation amount of the fuel vapor reaches the equilibrium state, the pressure in the purge device also reaches the stable state. Thus, the change of the fuel vapor concentration Cf is correlated with the pressure change in the purge device. Accordingly, it can be determined accurately whether the pressure in the purge device stabilizes and a state suitable for the leak diagnosis is reached based on that the change in the fuel vapor concentration Cf in the purge device becomes equal to or less than the reference value β. As a result, even if the period for the pressure in the purge device to stabilize fluctuates due to the environment in which the vehicle is located, the leak diagnosis can be performed immediately when the pressure in the purge device stabilizes and the state suitable for the leak diagnosis is reached. Accordingly, if Step S204 determines that the change ΔCf in the fuel vapor concentration Cf is equal to or less than the reference value β, the process goes to Step S206 to execute the leak diagnosis routine.

Figure 5:
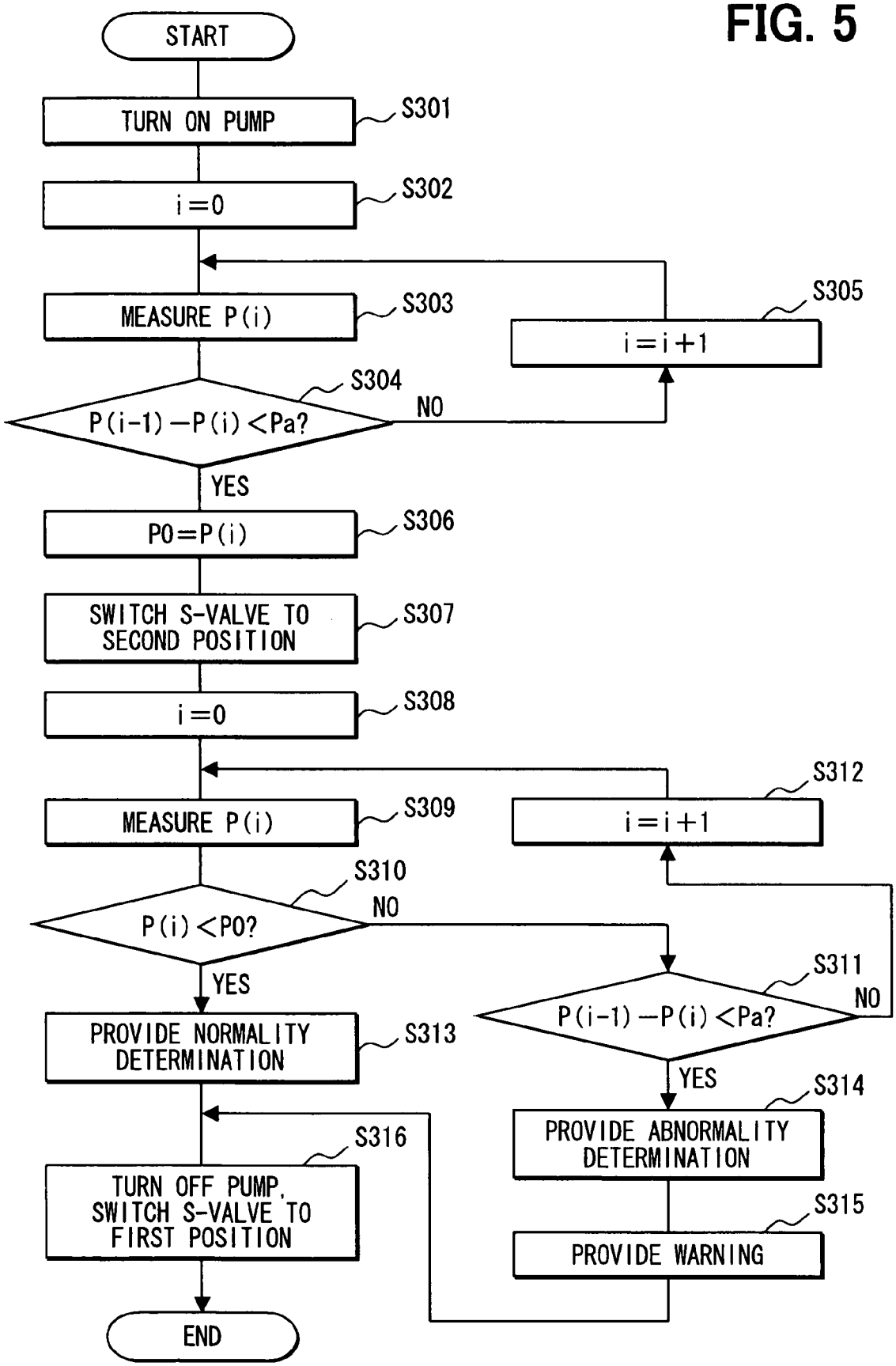
FIG. 5 is a flowchart showing a leak diagnosis routine according to the FIG. 1 embodiment.

Next, the leak diagnosis routine will be explained in reference to the operation waveform shown in FIG. 3, a flowchart shown in FIG. 5 and the like. A period F shown in the operation waveform of FIG. 3 is an execution waiting period of the leak diagnosis routine. A period G and a period H are leak diagnosis periods of the leak diagnosis routine.

Figure 6:
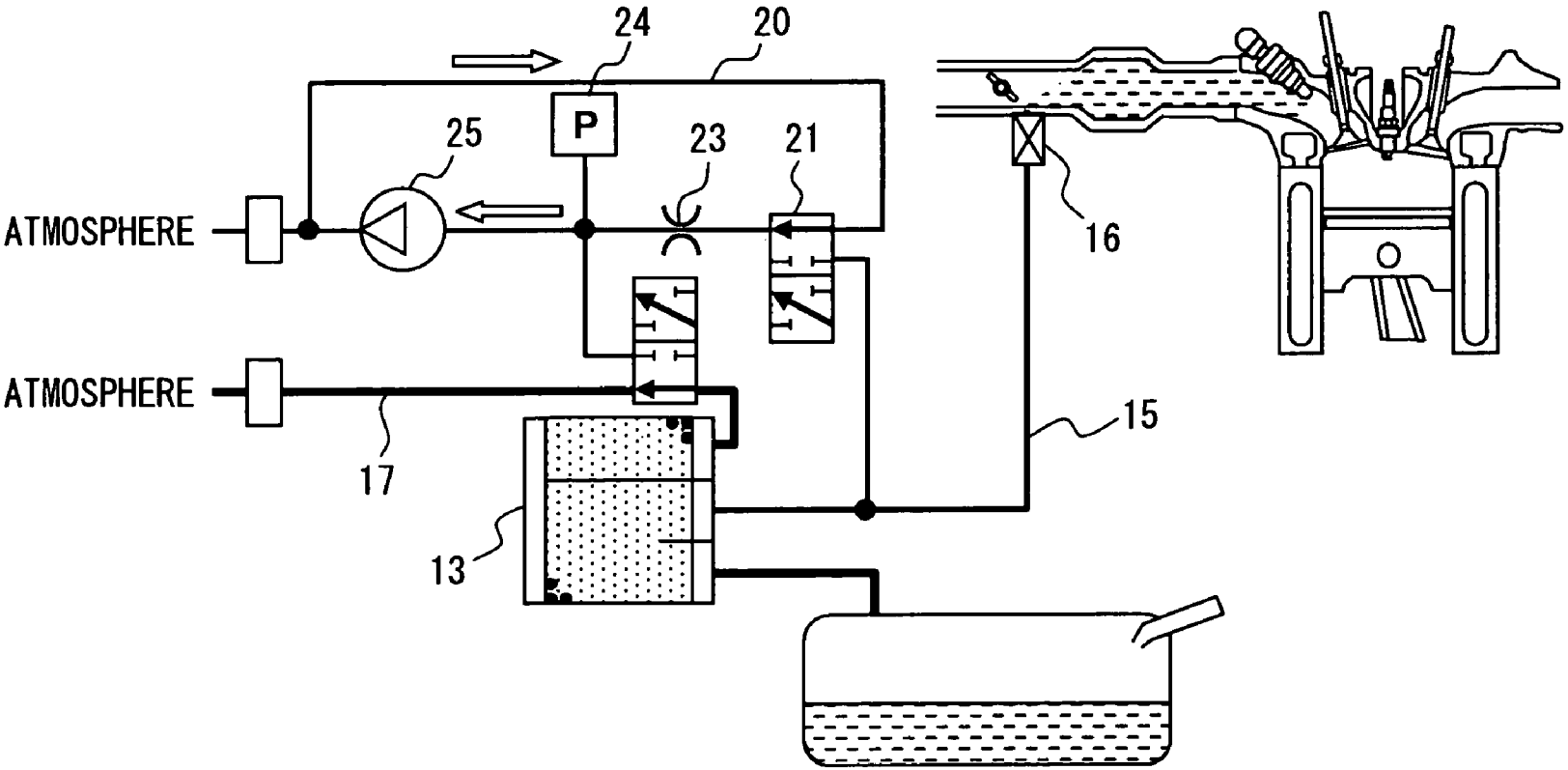
FIG. 6 is a diagram showing operation states of the respective parts of the purge device according to the FIG. 1 embodiment at the time when reference pressure is measured by using an airflow.

First, Step S301 turns on the pump 25. At that time, the switching valve 18 and the two-position valve 21 are at the first positions. Accordingly, the state at that time is equivalent to the first state of the concentration measurement. As shown in FIG. 6, the air flows through the measurement passage 22 and the pressure (negative pressure) is caused by the restrictor 23. Step S302 initializes a variable i to zero. Step S303 measures the pressure P(i).

Step S304 compares a difference (P(i−1)−P(i)) between the previously measured pressure P(i−1) and the presently measured pressure P(i) with a threshold value Pa to determine whether the difference (P(i−1)−P(i)) is less than the threshold value Pa. As shown by the G period in FIG. 3, the measured pressure P(i) decreases with the elapse of time after the drive of the pump 25 is started, and then, the pressure P(i) gradually converges to a pressure value defined by the passage sectional area of the restrictor 23 and the like. The processing of Step S304 determines whether the measured pressure P(i) reaches the converged value.

If Step S304 is NO, Step S305 increments the variable i and the process returns to the processing of Step S303. If Step S304 is YES, the process goes to the processing of Step S306.

Figure 7:
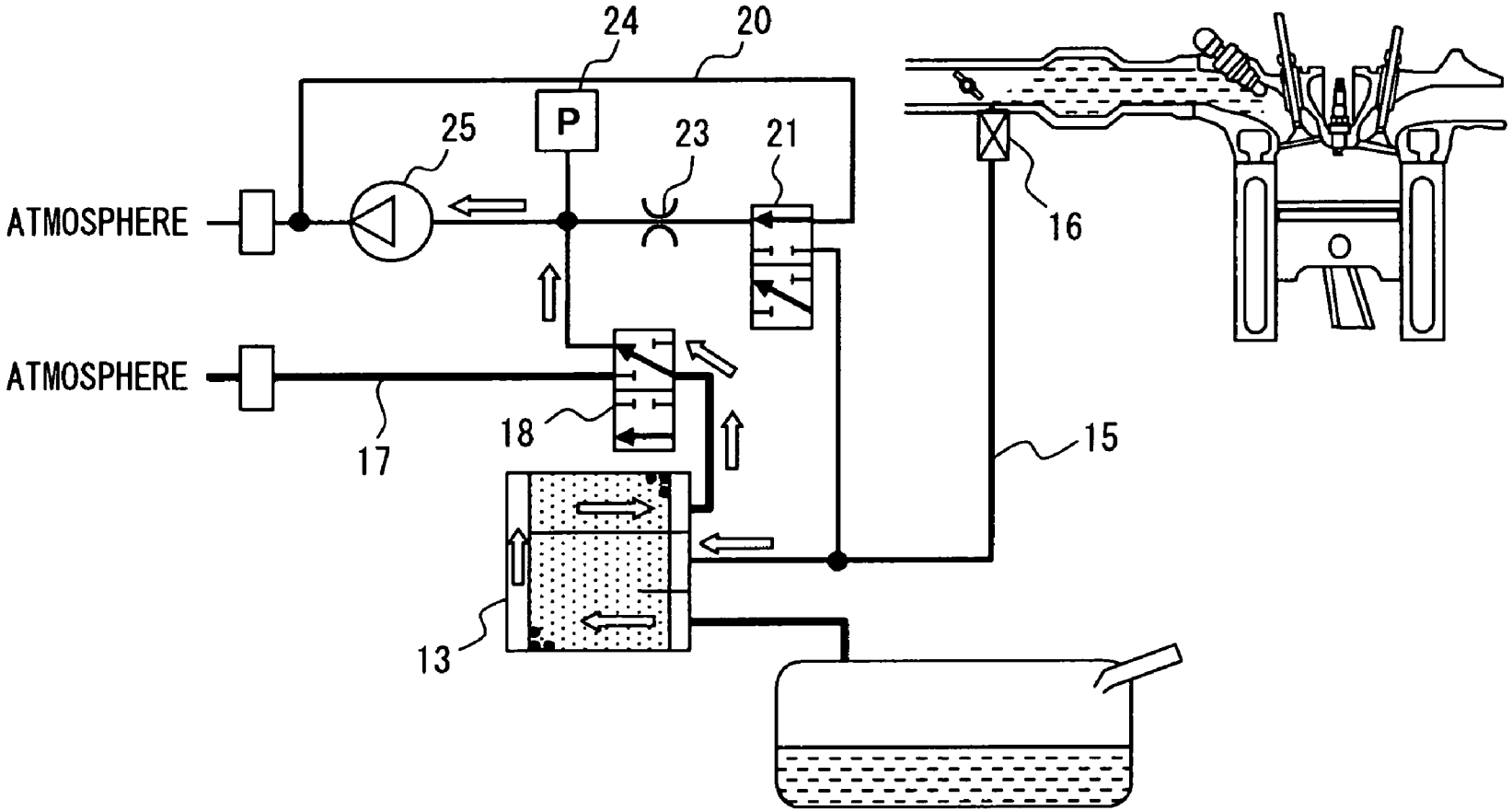
FIG. 7 is a diagram showing operation states of the respective parts of the purge device according to the FIG. 1 embodiment at the time when the purge device is depressurized and reduced pressure is measured.

Step S306 inputs the value P(i) into reference pressure P0 of the leak diagnosis. Step S307 switches the switching valve 18 to the second position (SECOND in FIG. 3) to bring the purge device to a state shown in the H period in FIG. 3. In this case, the purge gas existing in the fuel tank 11, the evaporation line 12, the canister 13, the purge line 15 and the like is suctioned by the pump 25 into the measurement passage 22 downstream of the restrictor 23, not through the restrictor 23, as shown in FIG. 7. Thus, the inside of the purge device is depressurized.

If there is no leak hole, the converged value of the measured pressure P(i) is lower than the reference pressure P0 since the purge device is hermetic. It can be determined that there is a leak hole having an opening area larger than the passage sectional area of the restrictor 23 in the purge device if the converged value of the measured pressure P(i) does not decrease to the reference pressure P0. Therefore, in the present embodiment, the measured pressure P(i) is compared with the reference pressure P0 at Steps S308 to S315 and normality/abnormality determination corresponding to existence/nonexistence of the leak hole is provided based on the result of the comparison.

Step S308 initializes the variable i to zero. Step S309 measures the pressure P(i) and Step S310 compares the measured pressure P(i) with the reference pressure P0. If Step S310 is YES (P(i)<P0), it can be determined that there is no leak hole in the purge device. Accordingly, Step S313 provides the normality determination indicating that there is no leak. If Step S310 is NO (P(i)≧P0), the process goes to processing of Step S311. Normally, the measured pressure P(i) has not decreased to the reference pressure P0 in an initial stage of the pressure measurement in the H period. Accordingly, Step S310 is NO.

Like Step S304, Step S311 compares the difference (P(i−1)−P(i)) between the last measured pressure P(i−1) and the presently measured pressure P(i) with the threshold value Pa to determine whether the measured pressure P(i) has reached to the convergence pressure. If Step S311 is NO, Step S312 increments the variable i and the process returns to the processing of Step S309. If Step S311 is YES, it can be determined that there is a leak hole having an opening area equal to or greater than the passage sectional area of the restrictor 23 in the purge device since the measured pressure P(i) does not decrease to the reference pressure P0 although the measured pressure P(i) has reached the convergence pressure. Therefore, the process goes to Step S314 to provide the abnormality determination indicating that there is a leak. Further, Step S315 provides a warning, for example, by using an indicator provided in an instrumental panel of the vehicle.

As described above, the criterion of the determination of the existence/nonexistence of the leak hole is the passage sectional area of the restrictor 23. The restrictor 23 is set in consideration of the area of the leak hole, which causes the abnormality determination to be provided.

Step S316 turns off the pump 25 and switches the switching valve 18 to the first position to bring the state of the purge device to the initial state as shown in an I period in FIG. 3.

Thus, in the present embodiment, the leak determination of the purge device can be performed by using the measurement line 22, the restrictor 23, the pump 25 and the pressure sensor 24 provided for the fuel vapor concentration measurement. Accordingly, the structure can be simplified.

The above-described embodiment can be modified as follows, for example.

In the above-described embodiment, the concentration measurement is performed each time the predetermined period elapses after the operation of the engine 1 is stopped. It is determined whether the fuel vapor concentration stabilizes based on whether the change between the previously measured concentration and the presently measured concentration becomes equal to or less than the reference value. Alternatively, it may be determined that the fuel vapor concentration has stabilized if the difference between the previously measured concentration and the presently measured concentration is equal to or less than the reference value predetermined multiple times successively to surely determine that the fuel vapor concentration has stabilized. In this case, the timing for determining that the concentration stabilization period is reached is somewhat delayed compared to the above-described embodiment. However, the stabilization of the fuel vapor concentration can be surely determined. By shortening the measurement interval of the concentration than before when the concentration change once becomes equal to or less than the reference value, the delay of the timing for determining that the concentration stabilizes can be restricted.

Alternatively, the fuel vapor concentration may be measured at least twice at predetermined timings after the operation of the engine 1 is stopped, e.g., at timing immediately after the stopping of the operation of the engine 1 and the timing when an hour passes after the stopping. The concentration stabilization period, in which the fuel vapor concentration change becomes equal to or less than the reference value, may be determined based on magnitude of the concentration change during the concentration measurement.

Figure 8:
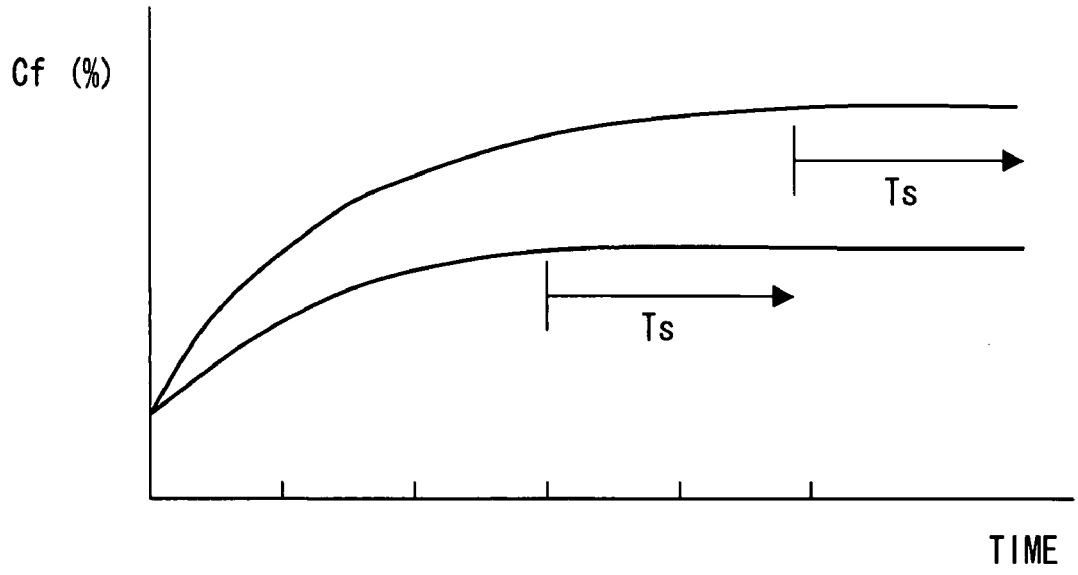
FIG. 8 is a graph for calculating a concentration stabilization period according to the FIG. 1 embodiment.
Figure 9:
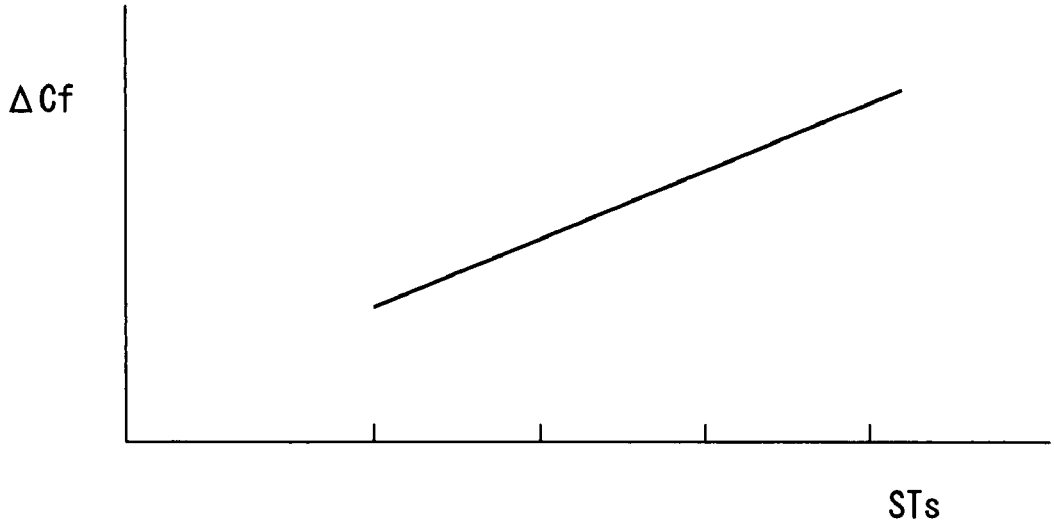
FIG. 9 is another graph for calculating the concentration stabilization period according to the FIG. 1 embodiment.

As shown in FIG. 8, the increase inclination of the fuel vapor is correlated with the start timing of the concentration stabilization period Ts. The fuel vapor concentration Cf is stabilized in an earlier stage as the increase inclination is more gradual. The timing for the fuel vapor concentration Cf to stabilize delays as the increase inclination becomes steeper. Therefore, by beforehand determining the timing for calculating the increase inclination of the concentration Cf, e.g., at the timing immediately after the engine is stopped and at the timing when an hour elapses after the stopping, the relationship between the concentration change ΔCf and the concentration stabilization start timing STs can be determined as shown in FIG. 9. By storing the relationship shown in FIG. 9 in the form of a map or a calculation formula, the concentration stabilization start timing STs can be estimated from the result of the concentration measurement performed at least twice at the predetermined timings.

In the above-described embodiment, the fuel vapor concentration of the purge gas is calculated from a ratio between the pressure generated by the restrictor 23 when the air is caused to flow through the measurement line 22 and the pressure generated when the purge gas is caused to flow. Alternatively, a sensor directly sensing the fuel vapor concentration in the purge gas (for example, HC sensor) may be used.

If the canister 13 adsorbs a large amount of the fuel vapor close to limit of an adsorbing ability and a breakdown state is reached such that there is no margin in the adsorbing ability, the generation of the fuel vapor in the fuel tank 11 directly affects the pressure change in the purge device. Specifically, when the ambient temperature is higher than certain temperature (for example, 30° C.), the generation amount of the fuel vapor becomes large. In such a case, the pressure in the purge device becomes unstable, so it becomes difficult to perform the leak diagnosis accurately.

Figure 10:
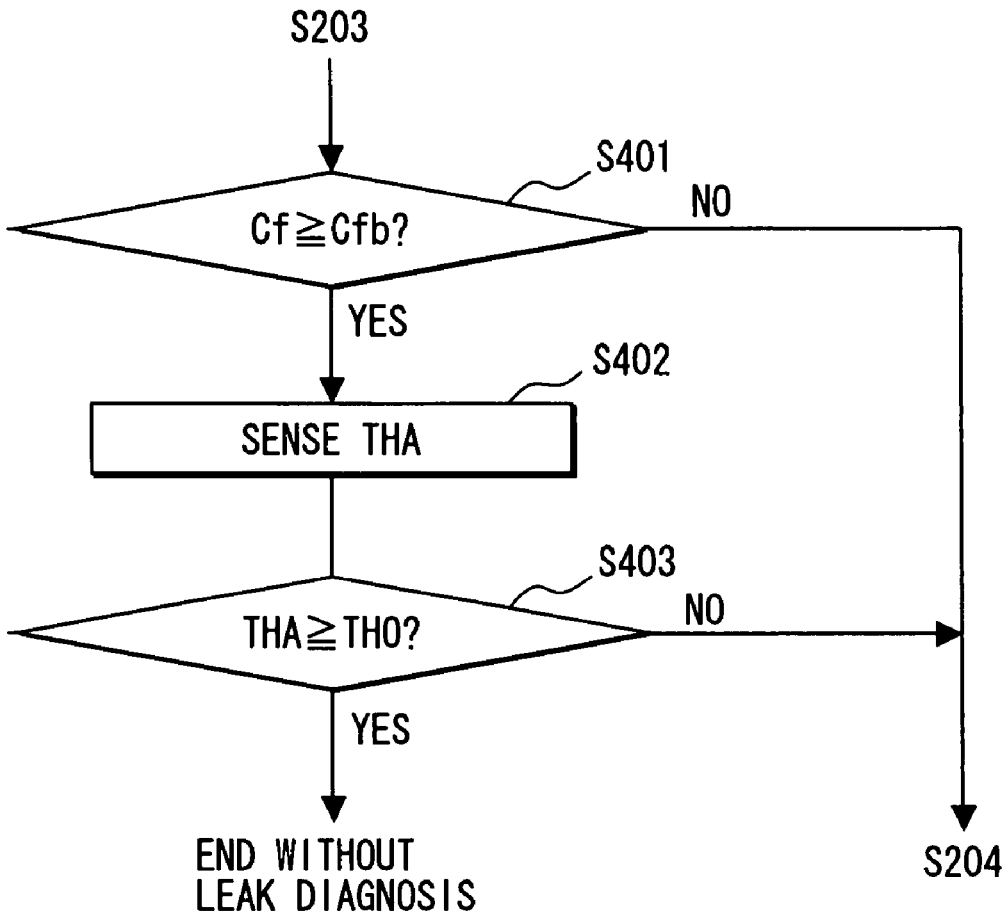
FIG. 10 is a flowchart showing processing of a modified example of the FIG. 1 embodiment.

Therefore, processing shown in FIG. 10 may be added to the flowchart shown in FIG. 4 of the leak diagnosis processing. The processing shown in FIG. 10 is added between the concentration measurement processing of Step S203 and the concentration change determination processing of Step S204 of the flowchart shown in FIG. 4. First, Step S401 determines whether the measured concentration Cf is "equal to or higher than" a breakdown determination concentration Cfb (for example, 90%) for determining the breakdown state of the adsorbent 14.

If the measured concentration Cf is lower than the breakdown determination concentration Cfb (S401: NO), there is no specific problem in execution of the leak diagnosis. Therefore, the process goes to the concentration change determination processing of Step S204 of the flowchart shown in FIG. 4. If Step S401 determines that the measured concentration Cf is equal to or higher than the breakdown determination concentration Cfb (S401: YES), the process goes to Step S402 to sense the ambient temperature THA. Then, Step S403 determines whether the sensed ambient temperature THA is "equal to or higher than" certain temperature TH0 (for example, 30° C.) promoting the generation of the fuel vapor. If Step S403 determines that the ambient temperature THA is lower than the certain temperature TH0 (S403: NO), it can be assumed that the generation amount of the fuel vapor is small and the accuracy of the leak diagnosis is ensured even if the breakdown of the adsorbent 14 of the canister 13 is caused. In this case, the process goes to the processing of Step S204 of the flowchart shown in FIG. 4. If it is determined that the ambient temperature THA is equal to or higher than the certain temperature TH0 (Step S403: YES), the leak diagnosis can be performed erroneously for the reason described above. Therefore, in this case, the processing of the flowchart shown in FIG. 4 is ended without performing the leak diagnosis routine.

The suctioning ability of the pump 25 may be switched between the period of measuring the fuel vapor concentration and the period of performing the leak diagnosis of the purge device. The pump suctioning ability can be changed by increasing/decreasing the rotation speed of the pump 25. If the pump 25 is driven at the high rotation speed to relatively increase the flow amount, the difference between the pressure of the air flow and the pressure of the purge gas flow caused by the restrictor 23 increases. As a result, a large measurement gain can be ensured. If the leak diagnosis is performed by driving the pump 25 at the high rotation speed, the inside of the purge device is depressurized. However, if the differential pressure between the inside and the outside of the fuel tank 11 becomes excessive, the molded-resin fuel tank 11 is unfavorably required to have strength corresponding to the excessive differential pressure. By driving the pump 25 at relatively low rotation speed during the leak diagnosis, the fuel tank 11 does not have to have excessively high strength.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A leak diagnosis device comprising:

a diagnosing device for performing leak diagnosis of determining whether a leak hole is formed in a purge device, which adsorbs fuel vapor generated in a fuel tank with an adsorbent in a canister and purges the fuel vapor adsorbed by the adsorbent into an intake passage of an internal combustion engine;

a state sensing device, when the fuel vapor adsorbed by the adsorbent separates from the adsorbent and produces a mixture gas, for sensing a state of the fuel vapor in the mixture gas; and a period calculating device for causing the state sensing device to perform the state sensing multiple times from a period in which the pressure in the purge device increases due to generation of the fuel vapor after an operation of the engine is stopped and for calculating a state stabilization period in which a change of the fuel vapor state becomes equal to or less than a reference value based on the result of the multiple times of the state sensing, wherein the diagnosing device performs the leak diagnosis in the state stabilization period calculated by the period calculating device.

2. The leak diagnosis device as in claim 1, wherein the state sensing device includes:

a measurement passage provided with a restrictor;

a gas flow generating device for generating a gas flow in the measurement passage;

a pressure measuring device for measuring pressure downstream of the restrictor when the gas flow generating device generates the gas flow;

a first switching device for switching between a first measurement state in which the measurement passage opens into an atmosphere such that the gas flowing through the measurement passage is an air and a second measurement state in which the measurement passage communicates with the canister such that the gas flowing through the measurement passage is the mixture gas containing the fuel vapor; and a state calculating device for calculating the state of the fuel vapor based on first pressure measured by the pressure measuring device in the first measurement state and second pressure measured by the pressure measuring device in the second measurement state, the diagnosing device has a second switching device for forming a third measurement state in which the mixture gas containing the fuel vapor flows from the canister to the measurement passage downstream of the restrictor not through the restrictor, and the diagnosing device performs the leak diagnosis of the purge device based on the first pressure measured by the pressure measuring device in the first measurement state and third pressure measured by the pressure measuring device in the third measurement state.

3. The leak diagnosis device as in claim 1, wherein the period calculating device causes the state sensing device to perform the state sensing for each elapse of a predetermined time after the operation of the engine is stopped and determines that the state stabilization period is reached if a difference between a previously sensed state and a presently sensed state is equal to or less than a predetermined value.

4. The leak diagnosis device as in claim 3, wherein the period calculating device determines that the state stabilization period is reached if the difference between the previously sensed state and the presently sensed state is equal to or less than the predetermined value certain times successively.

5. The leak diagnosis device as in claim 1, wherein the period calculating device estimates the state stabilization period, in which the change of the fuel vapor state is equal to or less than the reference value, based on magnitude of the state change occurring over two or more times of the state sensing.

6. The leak diagnosis device as in claim 1, further comprising:

an ambient temperature measuring device for measuring ambient temperature, wherein the diagnosing device sustains the leak diagnosis if the state sensing of the fuel vapor state performed after the operation of the engine is stopped detects a state in which a margin of an adsorbing ability of the adsorbent is short and the ambient temperature measured by the ambient temperature measuring device is equal to or higher than certain temperature.

7. A leak diagnosis method of performing leak diagnosis of determining whether a leak hole is formed in a purge device, which adsorbs fuel vapor with an adsorbent, the leak diagnosis method comprising the steps of:

sensing a state of the fuel vapor in a mixture gas produced by the fuel vapor separating from the adsorbent; and calculating a state stabilization period in which a change of the state of the fuel vapor is equal to or less than a reference value based on the result of multiple times of the sensing, wherein the leak diagnosis is performed in the state stabilization period.

* * * * *